US005727728A

United States Patent [19]

Sainz et al.

[11] Patent Number: 5,727,728

[45] Date of Patent: Mar. 17, 1998

[54] PROTECTIVE DEVICE FOR USE WITH CONTAINERS HAVING HANDHOLD OPENINGS

[76] Inventors: Raymond R. Sainz, 3224 Bryant St., Denver, Colo. 80211; Joseph S. Sainz, 5010 Umatilla St., Denver, Colo. 80221; Lynn J. McCarthy, 7825 E. Pleasant Run, Scottsdale, Ariz. 85258

[21] Appl. No.: 494,930

[22] Filed: Jun. 26, 1995

[51] Int. Cl.[6] ..... B65D 5/468

[52] U.S. Cl. ..... 229/117.16; 206/813; 428/41.7; 428/41.8; 428/138

[58] Field of Search ..... 229/117.16, 117.17; 220/771; 206/460, 815, 813; 428/41.7, 41.8, 138

[56] References Cited

U.S. PATENT DOCUMENTS

| | | | |
|---|---|---|---|
| 2,760,715 | 8/1956 | Sicking | 229/117.17 |
| 2,820,733 | 1/1958 | Sorel | 428/138 |
| 3,398,439 | 8/1968 | Fried et al. | 206/813 |
| 3,547,337 | 12/1970 | Pisarczak | 229/117.17 |
| 3,725,188 | 4/1973 | Kalt | 206/813 |
| 3,788,538 | 1/1974 | Kuenzi | 229/117.17 |
| 4,550,048 | 10/1985 | Nakagawa | 229/117.16 |
| 4,711,237 | 12/1987 | Kaiser | 428/41.7 |
| 5,074,461 | 12/1991 | Parker et al. | 229/117.16 |

FOREIGN PATENT DOCUMENTS

| | | | |
|---|---|---|---|
| 2610596 | 8/1988 | France | 229/117.16 |
| 9302930 | 2/1993 | WIPO | 229/117.16 |

*Primary Examiner*—Gary E. Elkins

*Attorney, Agent, or Firm*—Timothy J. Martin; Michael R. Henson

[57] ABSTRACT

A protective device is adapted for use with a handhold opening of a container to inhibit ingress of unwanted materials into the interior while permitting insertion of a hand for grasping the handhold opening. The protective device comprises a panel piece having a surrounding peripheral edge and a surrounding peripheral margin adjacent to this edge. A panel piece is sized and configured to have a panel size greater than the selected size and configuration of the handhold opening so that the margin portion is securable to the container wall to position and secure the panel piece in a secured state with the panel piece positioned over the handhold opening. A first adhesive material secures the margin portion to the wall in an area surrounding the handhold opening. Preferably, a second adhesive material is disposed proximately to the peripheral edge and spaced-apart from the first adhesive material. The second adhesive operates to releasably tack the peripheral edge of the panel piece to the wall when in the secured state.

21 Claims, 3 Drawing Sheets

PROTECTIVE DEVICE FOR USE WITH CONTAINERS HAVING HANDHOLD OPENINGS

FIELD OF THE INVENTION

The present invention broadly concerns the packaging of objects in containers so as to inhibit contact with the object by dust and other contaminant particles in the environment. More specifically, the present invention concerns the packaging of objects in boxes which have handhold openings formed through a wall thereof so that a user may manually grasp the box by inserting the hands through the handhold openings. This invention, then, is directed to structures which may mount over the handhold openings to prevent ingress of contaminants.

BACKGROUND OF THE INVENTION

The use of various containers, such as boxes, for the packaging of objects for storage and/or shipment is well-known. A large portion of these containers are in varied forms of corrugated paper boxes which provide a relatively inexpensive and disposable means for packaging the objects. Often, such cardboard boxes and other containers are provided with a pair of oppositely disposed handhold openings formed in the sidewall thereof which facilitate lifting and carrying the boxed object. In cardboard boxes, these handhold openings are typically die-cut through the sidewall of the box and may be either a simple opening or, alternatively, may be a hinged opening.

The presence of the handhold openings, where they communicate with the interior of the container, correspondingly reduce the effectiveness of the container's exclusion of contaminant materials from entering the interior. Accordingly, since the interior is not sealed, dust and other contaminants may migrate from the external environment to the interior of the container. Accordingly, while handhold openings provide a highly useful convenience, they are not without their drawbacks.

The ingress of dust and other contaminants into the interior of a container that houses an object is an increasing problem where the objects so packaged are delicate electronic equipment especially because of the electrostatic charges which may be on the equipment. The electrostatic charge can attract charged dust particles and other particulate contaminants. The need to isolate such electronic equipment is prevalent in the computer industry, but the intrusion of dust and other contaminants is a problem in the packaging and shipment of stereo equipment, medical equipment and even bicycles, to name a few products. Because of this, it is often the practice to "bag" the product in a sealed plastic wrapping and place the wrapped package in the container. This naturally adds increased costs in the form of materials and labor; it also increases the amount of discarded materials when the object is removed from the container. Thus, the bagging of objects for further packaging in a container is both a costly and a non-ecologically sound practice. Nonetheless, it has heretofore been necessary in order to protect the packaged object.

Accordingly, there is a need for better protective devices which can be used in conjunction with a container for packaging an object in order to inhibit contact of the object with contaminant, airborne particles. There is a further need for a combination container and protective device which can house an object in an efficient manner so as to reduce the likelihood of contamination of the object during storage and shipment. A need exists, therefore, for a simplified device which can be used with containers, such as cardboard boxes, in order to isolate the interior of the box from the outside environment where the box is provided with handhold openings.

SUMMARY OF THE INVENTION

It is an object of the present invention to provide a new and useful protective device which may be mounted on the interior of a container over a handhold opening in order to protect the interior against intrusion by contaminant particles.

Another object of the present invention is to provide an inexpensive protective structure which can mount over the handhold opening formed in the sidewall of a box or other container so as to isolate the interior of the box from the outside environment while permitting access for the hand through the handhold opening.

It is another object of the present invention to provide a protective device which mounts over a handhold opening in a container and which device is inexpensive and simple in construction and application.

Still a further object of the present invention is to provide a container for the packaging of objects which container both has handhold openings and protective devices for the container that masks the handhold openings thereby protecting the interior of the container from the external environment.

According to the present invention, then, a protective device is provided for use with a container when packaging an object wherein the container has an interior and a wall that is provided with a handhold opening of a selected size and configuration that communicates with the interior. The protective device according to the present invention is operative to inhibit ingress of unwanted materials into the interior through the handhold opening while permitting insertion of a hand for grasping the handhold opening.

Broadly, the present invention includes a panel piece that has a surrounding peripheral edge and a surrounding peripheral margin portion adjacent the peripheral edge. The panel piece is sized and configured to have a panel size greater than the selected size and configuration of the handhold opening of the container so that the margin portion is securable to the wall of the container thereby to position and secure the panel piece in a secured state with the panel piece positioned over the handhold opening. A first adhesive material is disposed on the peripheral margin portion and is operative to secure the panel piece in the secured state. The first adhesive material seals the margin portion to the wall in an area surrounding the handhold opening. This first adhesive is preferably disposed on the peripheral margin portion in a continuous uninterrupted first band around the margin portion. A peel-away backing panel may be used to protect the first adhesive material prior to securing the protective device to the container wall.

In its more specific structure, the peripheral margin portion of the panel piece is formed as a bi-fold structure that includes an inwardly folded hinged wing section joined to an extension panel section at a fold line that defines the peripheral edge of the panel piece. The hinged wing section has a centrally located portal that is positionable over the handhold opening when the panel piece is in the secured state. The first adhesive is then located on the hinged wing section such that the exclusion panel section may expand away from the hinged wing section in a bellows-like manner when the hand is inserted through the handhold opening in the portal. Thus, the exclusion panel section along with the hinged wing section create a chamber that receives the hand with the chamber being isolated from the box interior.

In this structure, the first band of first adhesive material is disposed on the hinged wing section proximately to the portal. A second adhesive material is also disposed on the hinged wing section with this second adhesive material being disposed proximately to the peripheral edge and spaced apart from the first band of first adhesive material. Moreover, it is preferred that the second adhesive material be less adherent than the first adhesive so that it is operative to releasably tack the peripheral edge of the panel piece to the wall when the panel piece is in the secured state. Accordingly, the peripheral edge will release from the wall upon insertion of the hand to the handhold opening. While the second adhesive material may be disposed at discontinuous segments around the peripheral edge, it is preferably formed as a continuous band extending around the hinged wing section of the margin portion.

Regardless of whether only the first adhesive material is present or whether both the first and second adhesive materials are present, it is desired that backing panel be releasably secured to the panel piece. The backing panel is operative to protect the adhesive materials prior to the panel piece being placed in the secured state. The backing panel, of course, is peeled away prior to the protective devices attachment to the wall of the container. Moreover, to facilitate manufacturing ease of the containers, the backing panel may be formed as an elongated strip with a plurality of panel pieces secured to this strip for consecutive use.

Where the protective device is formed to have a bi-fold margin portion, the hinged wing section terminates in a surrounding terminal edge opposite the peripheral edge of the panel piece. Thus, the portal is formed as a centrally located access opening surrounded by the terminal edge. While the panel piece may take on any desired geometrical configuration, so long as it is sized and configured to extend over the handhold opening and overlay a portion of the wall surrounding the panel opening, it is preferred that the panel piece be rectangular in configuration.

The present invention thus is directed to the protective device described above as well as an improvement to an existing container or box in the form of such a protective device that is operative to inhibit the ingress of unwanted materials into the interior of the box through a handhold opening. Moreover, the present invention includes a container that has a bottom wall, a top wall and a surrounding sidewall operative to enclose an interior with the surrounding sidewall having at least one, but preferably a plurality of handhold openings formed therethrough. A protective device is located in a secured state on the container with there being a protective device for each handhold opening. Each protective device, then, is as described above.

These and other objects of the present invention will become more readily appreciated and understood from a consideration of the following detailed description of the exemplary embodiments when taken together with the accompanying drawings, in which:

BRIEF DESCRIPTION OF THE DRAWINGS

FIG. 2(*b*) is a diagrammatic cross-sectional view of the prior art container having a hinged handhold opening;

FIG. 8(*b*) is a cross-sectional view, similar to FIG. 8(*a*) showing the protective device in an expanded state;

DETAILED DESCRIPTION OF THE EXEMPLARY EMBODIMENTS

The present invention is directed to a protective device that is adapted to be used with a container when packaging an object in order to inhibit ingress of unwanted materials into the interior of the container through handhold openings formed in a wall thereof. The present invention is also directed to a container provided with handhold openings and such protective devices. This invention is particularly is directed to corrugated paper boxes having die-cut handhold openings in order to isolate the interior of those boxes when objects, such as electronic equipment, medical equipment etc. are packaged for shipment and storage.

Figure 1:
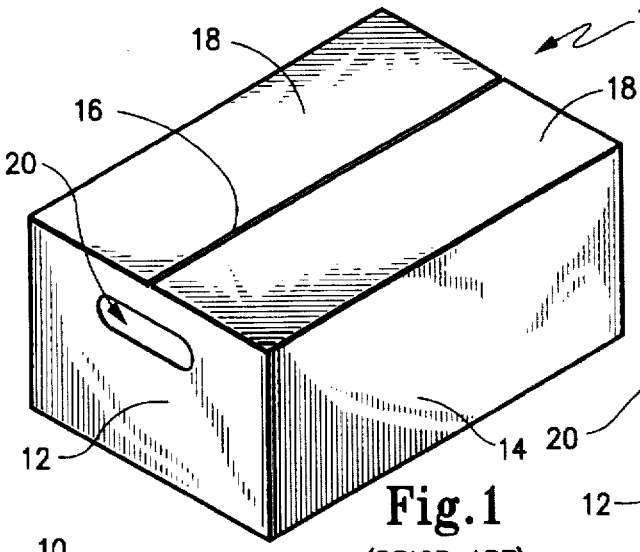
Fig.1 (PRIOR ART)
FIG. 1 is a perspective view of a representative prior art container used in the packaging of objects.

Accordingly, by way of example, as is shown in FIG. 1, a prior art container 10 is depicted as a cardboard box having a surrounding wall including a bottom wall (not shown), a pair of end walls, such as end wall 12, and a pair of sidewalls, such as sidewall 14. A top wall is formed by flaps 16 and 18 which may be folded over one another and sealed until the box is opened. End walls 12 are each provided with a handhold opening 20 of a selected size and configuration to allow the human hand to be inserted for grasping the handhold opening during the lifting of container 10.

Figure 2A:
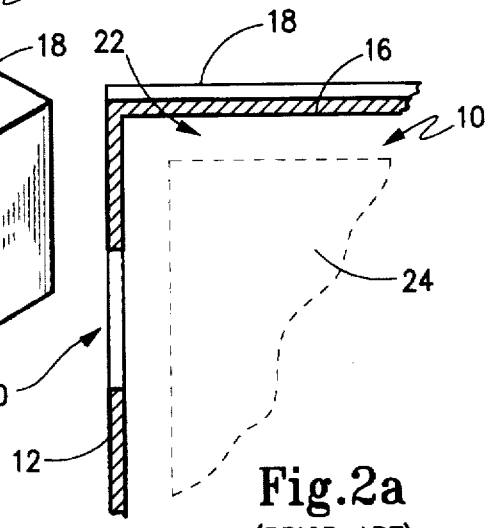
Fig.2a (PRIOR ART)
FIG. 2(*a*) is a diagrammatic view of a cross-section of the wall of the prior art container shown in FIG. 1 provided with a handhold opening.
Figure 2B:
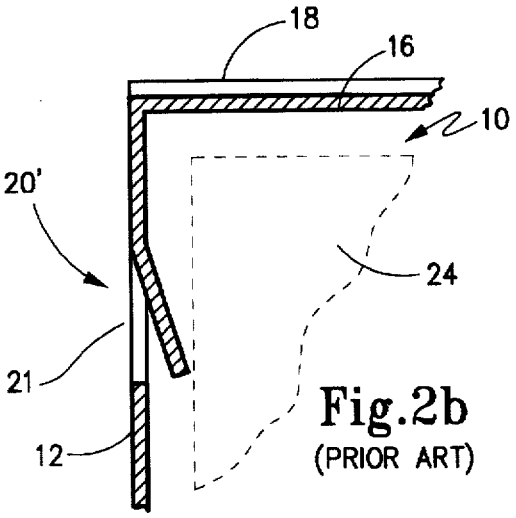
Fig.2b (PRIOR ART)

With reference first to FIG. 2(*a*), it may be seen that handhold opening 20 is simply a cut out portion which exposes the interior 22 of container 10 to the external environment. As is shown in this figure, in phantom, an object 24 placed in the interior 22 may thus be exposed to dust and other particulate contaminants which may enter interior 22 through handhold opening 20. In FIG. 2(*a*), it should also be appreciated that in the regions between object 24 and the various walls of container 10 may be filled with packaging material such as foam, bubble wrap, etc., to cushion the object during shipment. In FIG. 2(*b*), an alternative handhold opening 20' is shown for container 10 that houses object 24. Here, handhold opening 20' is provided by a cut-out which only extends on three sides of opening 20' thereby leaving a flap 21 hingedly attached to end wall 12. It should be understood that the present invention may be used with either of the type of handhold openings 20, 20'.

Figure 4:
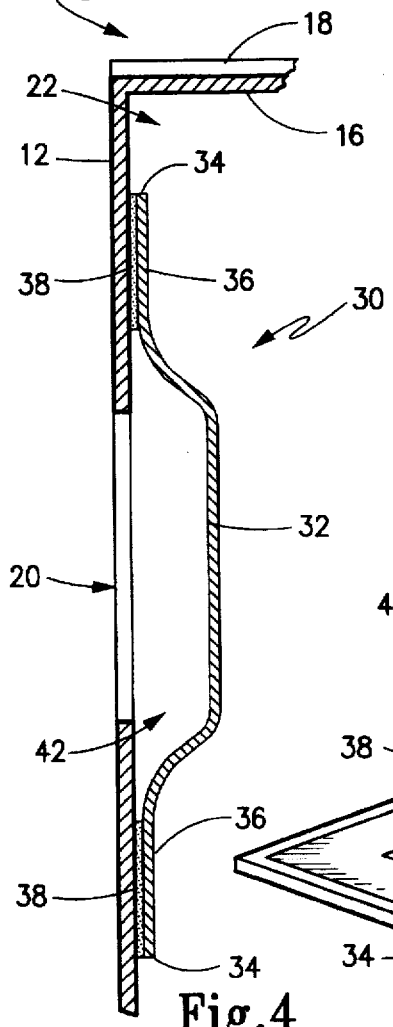
FIG. 4 is a cross-sectional view of the sidewall of a container having the protective device of FIG. 3 secured thereto in masking relation to a representative handhold opening.
Figure 3:
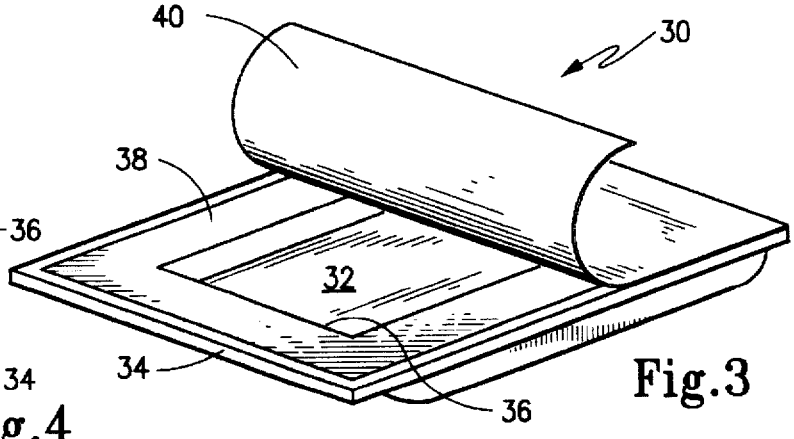
FIG. 3 is a perspective of a first exemplary embodiment of the protective device according to the present invention.
Figure 5:
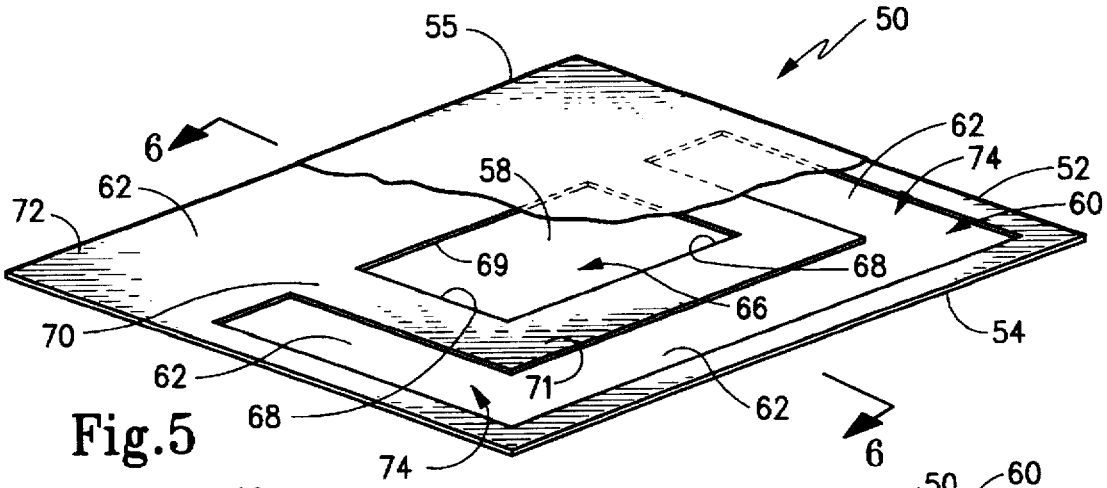
FIG. 5 is a perspective view, partially broken away, showing a second exemplary embodiment of the present invention.
Figure 6:
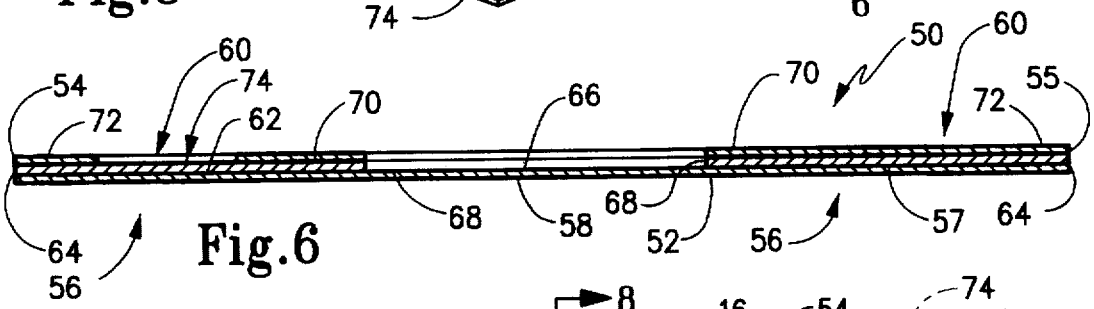
FIG. 6 is a cross-sectional view taken about lines 6—6 of Figure.
Figure 7:
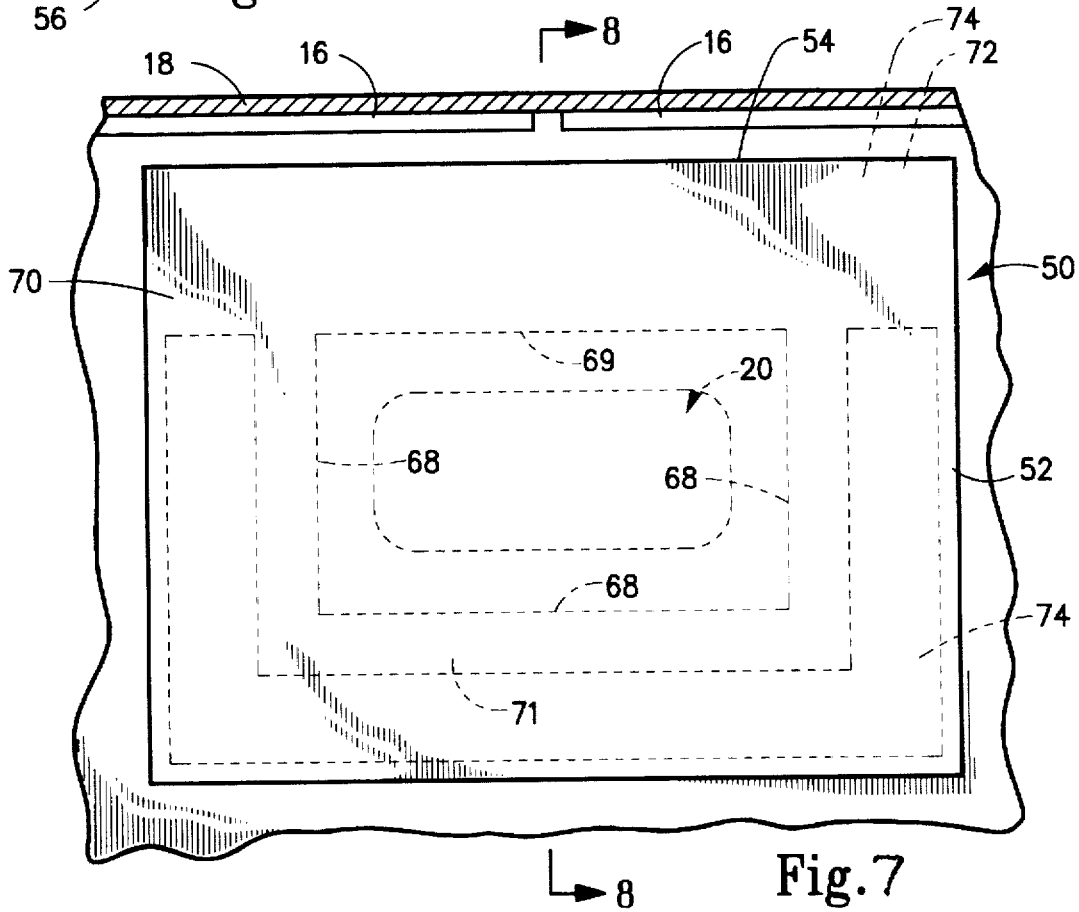
FIG. 7 is a top plan view showing the protective device of FIGS. 5 and 6 in a secured state on the sidewall of the container.

According to a simplified form of the present invention, as is shown in FIGS. 3 and 4, a protective device 30 is in the form of a panel piece 32 having a surrounding peripheral edge 34 and a peripheral margin 36 formed by a portion of panel piece 32 adjacent peripheral edge 34. Panel piece 32 is depicted in these figures as being rectangular in shape, but it is important that panel piece 32 be sized and configured to have a panel size greater than the selected size and configuration of the handhold opening on the container to which is to be attached. Panel piece 32 may be constructed of any suitable material, such as paper, plastic film and the like.

A first adhesive material 38 is disposed on the peripheral margin portion 36 and preferably forms a continuous, uninterrupted first band that extends around margin portion 36. Adhesive material 38 is temporarily protected by a peel-away backing panel 40 so as to releaseably secure panel piece 32 to backing panel 40 in order to protect the first adhesive prior to its being placed in a secured state on wall 12 of the representative container 10. The peel-away backing panel 40 may be simply removed during automated manufacturing or removed by hand if the protective device 30 is applied by hand to the wall 12 of container 10.

As is shown in FIG. 4, protective device 30 is fastened to wall 12. Here, panel piece 32 is in a secured state wherein it is positioned over the handhold opening 20 such that adhesive 38 acts to secure and seal margin portion 36 completely around the perimeter of opening 20. Preferably, as is shown in this figure, panel piece 32 bulges inwardly into the interior 22 of container 10. Thus, when in the secured state, panel piece 32 forms a chamber 42 that both communicates with opening 20 so as to allow insertion of a hand for grasping handhold opening 20 and which isolates the interior 22 from the external environment. Where panel piece 32 is formed of a plastic film, such film can be stretchable to allow creation of the bulge when the hand is inserted through the handhold opening.

A more preferred construction of a protective device according to the present invention, however, is shown in FIGS. 5–8. In these figures, it may be seen that protective device 50 is formed by a panel piece 52 that has a surrounding peripheral edge 54 and a peripheral margin 56 located adjacent to peripheral edge 54. Here, however, panel piece 52 is formed by an exclusion panel section 58 while margin portion 56 is formed by a bi-fold structure 60 that includes an inwardly folded hinged wing section 62 joined to exclusion panel section 58 at a fold line 64 that defines the peripheral edge 54 of panel piece 52. Exclusion panel section 58 and hinged wing section 62 are each preferably formed of a suitable paper material. Furthermore, they may be independent paper sheets or the panel piece 52 may be constructed as an integral one-piece sheet folded onto itself about one peripheral edge portion.

The hinged wing section 62 extends completely around peripheral edge 54 and has a portal 66 located therein. As is shown in these figures, portal 66 is a centrally located opening that is adapted to be positioned over the handhold opening when the panel piece is in the secured state. Thus, hinged wing section 62 terminates in a terminal edge 68 that is opposite the peripheral edge 54 of panel piece 52. This portal thereby forms a centrally located access opening surrounded by terminal edge 68. Preferably, this access opening is geometrically similar to the shape of panel piece 52.

Figure 8A:
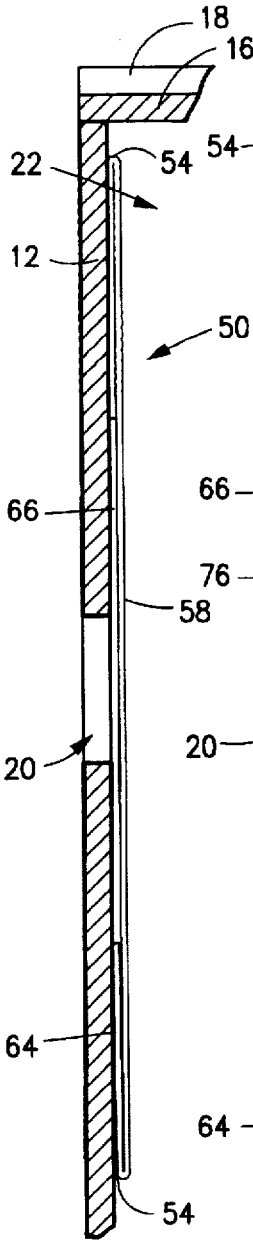
FIG. 8(*a*) is a side view in cross-section taken about lines 8—8 of FIG. 7 with the protective device in a collapsed state.
Figure 8B:
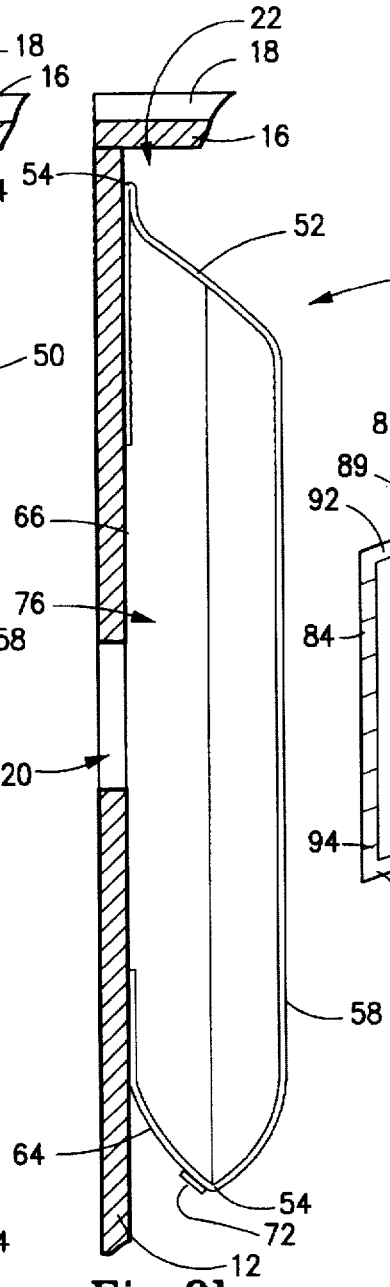

A first adhesive 70 is disposed on hinged wing section 62 and extends completely around portal 66 as a continuous uninterrupted band adjacent to portal 66, that is, adjacent terminal edge 68. First adhesive 70 completely covers a top marginal area 57 that is adjacent a top peripheral edge portion 55 and that is located between edge portion 55 and a top portion of portal 66 along a top terminal edge portion 69. A U-shaped portion 71 of first adhesive material 70 extends alongside the remainder of the terminal edge 68. Moreover, a second adhesive 72 is disposed on hinged wing section 12 and extends as a U-shaped, continuous, uninterrupted band located proximately to the peripheral edge 54 and spaced apart from the U-shaped portion 71 of the first band of the first adhesive 70. Thus, a region 74 located between the first adhesive 70 and the second adhesive 72 is non-adhering. It is desirable that first adhesive 70 be a substantially strong adhesive in order to adequately seal hinged wing section 62 to wall 12 of container 10 so as to isolate the interior of the container 10 from the external environment. Adhesive 72, on the other hand, is weaker in its adhering properties than is adhesive 70. Hence, adhesive 72 serves to releasably tack the peripheral edge 54 of panel piece 52 to wall 12, as is shown in FIG. 8(*a*). The top marginal area remains affixed to the wall above the handhold opening 20, however. In the manufacturing process, it is preferred that these two adhesives be the same base adhesive, such as a suitable acrylic adhesive with second adhesive 72 being sufficiently "deadened" to diminish its adhering ability, as is known in the art. Further, it is possible that region 74 be coated by the adhesive but that, in this region, it be completely deadened so as to have no adhering property. In any event, releasable, peel-away backing panel 78 is provided to protect the adhesives prior to attachment of panel piece 52 to the wall 12.

With reference to FIGS. 8(*a*) and 8(*b*) it may be seen that protective device 50 may move from a flattened state, shown in FIG. 8(*a*) to an expanded state shown in FIG. 8(*b*) wherein exclusion panel 58 expands away from hinged wing section 64, in a "bellows-like" manner. This expansion creates a chamber 76 that is operative to receive the hand when inserted through the handhold opening and the portal 66. Thus, chamber 76 communicates through portal 66 and handhold opening 20 to the external environment, for insertion of the hand, while chamber 76 remains isolated from the interior 22 of box 10 by virtue of the sealed attachment of hinged wing section 64 to wall 12 by adhesive 70. The bellows-like expansion of protective device 50 is permitted by the releasable, tacky nature of adhesive 72 which holds protective device 50 in the flattened state, shown in FIG. 8(*a*) yet which releases upon insertion of the hand to the expanded state. This tacking of protective panel 50 into the flattened state facilitates the packaging of an object in the interior of the container yet allows easy insertion of the hand in grasping the container. It should be understood that adhesive material 72 does not have to be formed in a continuous, uninterrupted band, but rather adhesive material 72 may be disposed on hinged wing section 62 as a series of discontinuous segments. Furthermore, the tacky adhesive material 72 could as well be disposed between hinged wing section 62 and exclusion panel 58 so as to tack them together into the flattened state prior to expansion.

Figure 9:
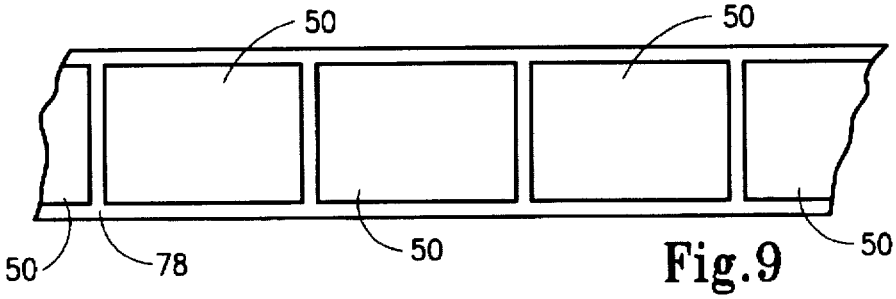
FIG. 9 is a top plan view showing a plurality of the protective devices such as those shown in FIGS. 1 and 5, mounted on an elongated backing strip.

With reference now to FIG. 9, it may be seen that backing panel 78 may be formed as a continuous, elongated strip to which are releasably secured a plurality of protective devices 50. This allows sequential protective devices 50 to be fed off of band 78 when applied to a container 10 in an automated manufacturing process.

Figure 10:
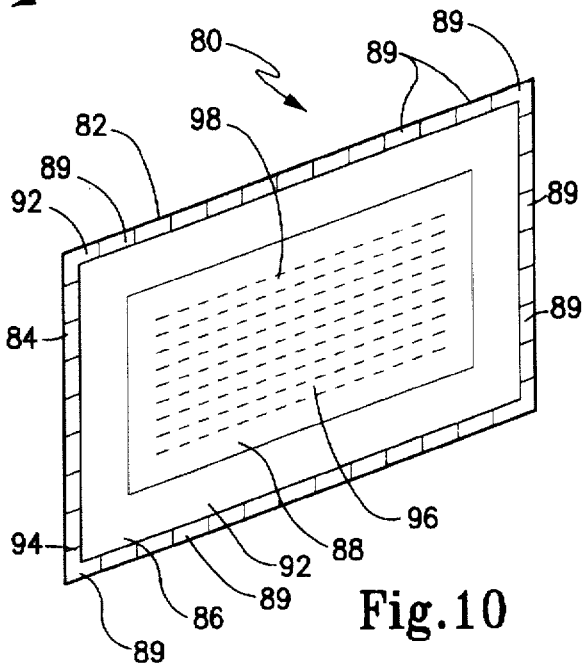
FIG. 10 is a perspective view of yet another alternative embodiment of the present invention.

With reference now to FIG. 10, a third exemplary embodiment of the present invention is shown in the form of a protective device 80 which is similar in construction to protective device 50 except as it relates to the portal structure and the first and second adhesive bands. In FIG. 10, protective device 80 includes a panel piece 82 having a peripheral edge 84 and a peripheral margin portion 86 adjacent peripheral edge 84. Peripheral margin portion 86 is formed as a bi-fold structure, similar to bi-fold structure 60 and includes hinged wing section 92 that is connected to an exclusion panel (not shown) at a fold line 94 that defines peripheral edge 84. A portal 96 is centrally located with respect to and bounded by hinged wing section 92. Here, however, portal 96 and hinge structure 92 are formed by a common sheet of paper-like material with portal 96 being formed by a plurality of slits 98 cut in a rectangular pattern so that, on insertion of a hand through the handhold opening 20, slits 98 tear-away from one another. First adhesive material 88 is formed as a discrete continuous band around portal 96 while second adhesive material 89 extends as a discrete broken band proximate to peripheral edge 84 with the band of adhesive 90 being spaced apart from adhesive 88 and which is not connected to any part of first adhesive material 88. This band of second adhesive material 89 could be continuous, if desired. Naturally, any adhesive band structure could be used on either embodiment, though, without departing from the scope of this invention.

The present invention thus is directed to the protective device described above as well as to an improvement to an existing container or box in the form of such a protective device that is operative to inhibit the ingress of unwanted materials into the interior of the box through a handhold opening. Moreover, the present invention includes the combination of a container that has a bottom wall, a top wall and a surrounding sidewall operative to enclose an interior with the surrounding sidewall having at least one, but preferably a plurality of handhold openings formed therethrough. A protective device is located in a secured state on the container with there being a protective device for each handhold opening.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

We claim:

1. A protective device adapted to be used with a container when packaging an object wherein the container has an interior and a wall that is provided with a handhold opening of a selected size and configuration, the protective device operative to inhibit ingress of unwanted materials into the interior through the handhold opening while permitting insertion of a hand for grasping the handhold opening, comprising:

(a) a panel piece having a surrounding peripheral edge and a surrounding peripheral margin portion adjacent to the peripheral edge, said panel piece sized and configured to have a panel size greater than the selected size and configuration of the handhold opening so that said margin portion is securable to said wall thereby to position and secure said panel piece in a secured state with said panel piece positioned over the handhold opening;

(b) a first adhesive material disposed on said peripheral margin portion and operative to secure said panel piece in the secured state and to seal said margin portion to said wall in an area surrounding the handhold opening and (c) a second adhesive material disposed on said peripheral margin portion in a spaced-apart relation to said first adhesive material, said second adhesive material being less adhering than said first adhesive material and operative to releasably tack the panel piece to the wall of said container when the panel piece is in the secured state such that a portion of the panel piece will release from said wall upon insertion of the hand through the handhold opening.

2. A protective device according to claim 1 wherein said first adhesive material extends in a continuous, uninterrupted first band around said margin portion.

3. A protective device according to claim 1 wherein said panel piece is rectangular in configuration.

4. A protective device according to claim 1 including a peel-away backing panel to which said panel piece is releasably secured, said backing panel operative to protect said first adhesive prior to being placed in the secured state on said wall.

5. A protective device according to claim 4 wherein said backing panel is formed as an elongated strip, there being a plurality of said panel pieces secured to said strip.

6. In a container that is adapted for use in packaging an object wherein the container has an interior and a wall that is provided with a handhold opening of a selected size and configuration, the improvement comprising a protective device that is operative to inhibit ingress of unwanted materials into the interior through the handhold opening while permitting insertion of a hand for grasping the handhold opening, said protective device including a panel piece having a surrounding peripheral edge and a surrounding peripheral margin portion adjacent to the peripheral edge, said peripheral margin portion formed as a bi-fold structure that includes an inwardly folded hinged wing section that has a portal and is joined to an exclusion panel section at a fold line that defines the peripheral edge of said panel piece, and including a continuous, uninterrupted first band of a first adhesive material located on said margin portion, said panel piece sized and configured to have a panel size greater than the selected size and configuration of the handhold opening so that said margin portion is secured to said wall by said band of the first adhesive material thereby to position and secure said panel piece in a secured state with said panel piece and said portal positioned over the handhold opening, said first adhesive material being located on said hinged wing section such that said exclusion panel section may expand away from said hinged wing section when the hand is inserted through the handhold opening and the portal thereby to create a chamber that may receive a hand inserted through the handhold opening, the first adhesive material operative to seal said margin portion to said wall in an area completely surrounding the handhold opening so that the chamber is isolated from the interior of said container.

7. The improvement according to claim 6 wherein said first band of first adhesive material is disposed on said hinged wing section proximately to the portal and including a second adhesive material on said hinged wing section, said second adhesive material disposed proximately to the peripheral edge and spaced-apart from said first band of said first adhesive material and operative to releasable tack the peripheral edge of the panel piece to the wall of said box when said panel piece is in the secured state.

8. The improvement according to claim 7 wherein said second adhesive material is less adhering than said first adhesive material such that the peripheral edge will release from said wall upon insertion of the hand through the handhold opening and the portal structure.

9. The improvement according to claim 7 wherein said second adhesive is configured as a continuous second band that surrounds said first band in spaced-apart relation thereto.

10. The improvement according to claim 6 wherein said hinged wing section terminates in a surrounding terminal edge opposite the peripheral edge of said panel piece, the portal thereby being formed as a centrally located access opening surrounded by the terminal edge.

11. A container adapted for use in packaging an object comprising:

(a) a bottom wall, a top wall and a surrounding sidewall operative to enclose an interior, said surrounding sidewall having a handhold opening formed therethrough, the handhold opening of a selected size and configuration;

(b) a protective device including a panel piece integrally formed from a single piece of panel material and having a surrounding peripheral edge and a surrounding peripheral margin portion adjacent to the peripheral edge, said peripheral margin portion formed as a bi-fold structure that includes an inwardly folded hinged wing section joined to an exclusion panel section at a fold line that defines the peripheral edge of said panel piece, said panel piece sized and configured to have a panel size greater than the selected size and configuration of the handhold opening and said hinged wing section having a portal that is positioned over the handhold opening, said panel piece secured to a portion of said sidewall that surrounds the handhold opening in a secured state so that said peripheral margin portion is sealed to said portion of said sidewall, said protective device thereby operative to inhibit ingress of unwanted materials into the interior through the handhold opening while permitting insertion of a hand for grasping the handhold opening; and (c) a first adhesive material located on said peripheral margin portion and formed as a continuous, uninterrupted first band around said margin portion, said first band of the first adhesive material operative to sealably secure said margin portion to said portion of said sidewall and located on said hinged wing section such that said exclusion panel section may expand away from said hinged wing section when the hand is inserted through the handhold opening and the portal thereby to create a chamber that receives the hand with the chamber being isolated from the interior.

12. A container according to claim 11 wherein said first band of first adhesive material is located proximately to the portal and including a second adhesive material on said hinged wing section, said second adhesive material located proximately to the peripheral edge and spaced-apart said first band of said first adhesive material and operative to releasable tack the peripheral edge of the panel piece to the sidewall.

13. A container according to claim 12 wherein said second adhesive material is less adhering than said first adhesive such that the peripheral edge will release from said sidewall upon insertion of the hand through the handhold opening and the portal structure.

14. A container according to claim 13 wherein said second adhesive material is configured as a continuous, uninterrupted second band that surrounds said first band in spaced-apart relation thereto.

15. A container according to claim 11 wherein said hinged wing section terminates in a surrounding terminal edge opposite the peripheral edge of said panel piece, the portal thereby being formed as a centrally located access opening surrounded by the terminal edge.

16. A protective device adapted to be used with a container when packaging an object wherein the container has an interior and a wall that is provided with a handhold opening of a selected size and configuration, the protective device operative to inhibit ingress of unwanted materials into the interior through the handhold opening while permitting insertion of a hand for grasping the handhold opening, comprising:

(a) a panel piece having a surrounding peripheral edge and a surrounding peripheral margin portion adjacent to the peripheral edge, said peripheral margin portion formed as a bi-fold structure that includes an inwardly folded hinged wing section joined to an exclusion panel section at a fold line that defines the peripheral edge of said panel piece, said panel piece sized and configured to have a panel size greater than the selected size and configuration of the handhold opening so that said margin portion is securable to said wall thereby to position and secure said panel piece in a secured state with said panel piece positioned over the handhold opening and with said hinged wing section having a portal that is positionable over the handhold opening; and (b) first adhesive material operative to secure said panel piece in the secured state and to seal said peripheral margin portion to said wall in an area surrounding the handhold opening, said first adhesive material located on said hinged wing section such that said exclusion panel section may expand away from said hinged wing section when the hand is inserted through the handhold opening and the portal thereby to create a chamber that receives the hand with the chamber being isolated from the interior of the container.

17. A protective device according to claim 16 wherein said panel piece is integrally formed from a single piece of panel material.

18. A protective device according to claim 16 wherein said first band of the first adhesive material is disposed on said hinged wing section proximately to the portal and including a second adhesive material on said hinged wing section, said second adhesive disposed proximately to the peripheral edge and spaced-apart said first band of said first adhesive material and operative to releasably tack the peripheral edge of the panel piece to the wall of said container when said panel piece is in the secured state.

19. A protective device according to claim 18 wherein said second adhesive material is less adhering than said first adhesive material such that the peripheral edge will release from said wall upon insertion of the hand through the handhold opening and the portal structure.

20. A protective device according to claim 18 wherein said second adhesive is configured as a continuous second band that surrounds said first band in spaced-apart relation thereto.

21. A protective device according to claim 16 wherein said hinged wing section terminates in a surrounding terminal edge opposite the peripheral edge of said panel piece, the portal thereby being formed as a centrally located access opening surrounded by the terminal edge.

* * * * *